US006146078A

United States Patent [19]

Hamill et al.

[11] Patent Number: 6,146,078

[45] Date of Patent: Nov. 14, 2000

[54] REFUSE BODY HAVING SINGLE-STAGE PACKING AND FULL EJECTION

[75] Inventors: Odis F. Hamill, San Antonio; Hooshang A. Befrui, Houston, both of Tex.

[73] Assignee: Pak-Mor Manufacturing Company, San Antonio, Tex.

[21] Appl. No.: 09/155,037

[22] PCT Filed: Mar. 19, 1997

[86] PCT No.: PCT/US97/04389

§ 371 Date: Sep. 17, 1998

§ 102(e) Date: Sep. 17, 1998

[87] PCT Pub. No.: WO97/35788

PCT Pub. Date: Oct. 2, 1997

Related U.S. Application Data

[60] Provisional application No. 60/014,032, Mar. 25, 1996.

[51] Int. Cl.[7] ..... B65F 3/20; B65F 3/28

[52] U.S. Cl. ..... 414/511; 414/512; 414/517; 414/525.55; 414/525.6; 414/813

[58] Field of Search ..... 414/406, 492, 414/510, 511, 512, 513, 516, 517, 525.2, 525.55, 525.6, 813; 198/418.5, 747; 100/269.01, 270

[56] References Cited

U.S. PATENT DOCUMENTS

| | | | |
|---|---|---|---|
| 3,865,260 | 2/1975 | Wieschel et al. . | |
| 3,921,839 | 11/1975 | Herpich | 414/406 X |
| 4,057,157 | 11/1977 | Park et al. . | |
| 4,096,956 | 6/1978 | Gaskin . | |
| 4,316,695 | 2/1982 | Knight, Sr. | 414/517 |
| 4,544,320 | 10/1985 | Haines | 414/517 X |
| 4,552,500 | 11/1985 | Ghibaudo et al. | 414/492 X |
| 4,627,783 | 12/1986 | De Filippi | 414/492 X |
| 4,877,366 | 10/1989 | De Filippi | 414/517 |
| 5,857,822 | 1/1999 | Christenson | 414/517 X |
| 5,885,049 | 3/1999 | McNeilus et al. | 414/512 |

FOREIGN PATENT DOCUMENTS

| | | |
|---|---|---|
| 1239377 | 7/1988 | Canada . |
| 3447814 | 12/1984 | Germany . |
| 1100204 | 6/1984 | U.S.S.R. . |

*Primary Examiner*—James W. Keenan
*Attorney, Agent, or Firm*—Sidley & Austin

[57] ABSTRACT

This invention relates generally to refuse collecting and disposal vehicles. In one aspect, it relates to a refuse body adapted to be mounted on a conventional refuse vehicle chassis for loading, compacting and ejecting refuse without tilting of the body.

9 Claims, 5 Drawing Sheets

REFUSE BODY HAVING SINGLE-STAGE PACKING AND FULL EJECTION

This appln. is a 371 of PCT/US97/04389 filed Mar. 19, 1997 and also claims the benefit of Provisional No. 60/014,032 filed Mar. 25, 1996.

BACKGROUND OF THE INVENTION

Refuse vehicles are typically used by municipalities and waste-removal contractors to collect refuse material from widely dispersed sources such as residences or commercial establishments and to transport the collected refuse to a central dump site such as a landfill, recycling center, or transfer point where it can be ejected. Since the dump site may be located a long distance from the collection area, it is desirable to "pack" (i.e, compress or compact), the refuse material as it is collected so as to maximize the number of sources which can be serviced by a vehicle of a given storage capacity before another trip to the dump site is necessary. A refuse vehicle typically comprises a conventional truck chassis or trailer chassis upon which is mounted a refuse body having apparatus for collection, packing, storage, and ejection of the refuse.

Three general classes of refuse vehicles are commonly encountered. A "rear-loader" type refuse vehicle is typically provided with a hopper, i.e., receiving compartment, which is accessible from the rear of the vehicle and a movable blade for packing the refuse forward from the hopper into a storage area for storage. A "front-loader" type vehicle is typically provided with a hopper which is accessible from the top, a power-actuated loading mechanism for elevating and dumping refuse containers from the front of the vehicle into the hopper, and a movable blade for packing the refuse rearward from the hopper into a storage area for storage. A "side-loader" type vehicle is typically provided with a hopper which is accessible from the side. Some side-loaders have a power-actuated loading mechanism adapted for gripping, elevating and dumping refuse containers from the side of the vehicle into the hopper, however, other side-loaders utilize manual feeding of the hopper. A movable blade is also provided for packing the refuse rearward from the hopper into a storage area for storage.

It is generally desirable to maximize the number of sources served by a refuse vehicle during a given time period. In many situations the vehicle's crew can access refuse containers for loading into the hopper faster that the packing blade can complete its packing cycle, i.e., extending the packing blade to pack material from the hopper into the storage compartment, then retracting the packing blade to its original position. Many refuse body designs, however, cannot accommodate loading of the hopper until the packing blade has finished its packing cycle since refuse material may otherwise fall behind the extended blade and jam the mechanism. In these cases, the crew must wait for the packing blade to complete its cycle before loading the hopper, thus increasing the time required for the crew to complete their route. A need therefore exists, for a refuse body apparatus which allows dumping of refuse material into the loading compartment at any time during the packing operation.

After the storage area of the refuse body has been filled with packed refuse material, the material must be transported to the dump site and ejected. In some vehicles, this ejection is accomplished by opening a rear door on the body and tilting the entire body at an angle so that the packed "bale" of refuse slides out of the opened rear door. However, tilting the refuse body during the ejection operation raises the center of gravity of the entire vehicle, making it more susceptible to overturning, a very dangerous condition. This danger is especially high when the ejecting operation takes place at a dump site having soft or non-level ground, such as a landfill. A need therefore exists, for a refuse body apparatus having full ejection of refuse without tilting of the body.

In other vehicles, ejection of the packed refuse bale is accomplished by opening a rear door and extending an ejecting blade from the front of the storage compartment to the rear doorway, thereby pushing the refuse bale out the opened rear door without tipping the body. This is termed "full ejection." While this full ejection method avoids the dangers inherent in the tipping of the body, it typically requires an ejecting blade actuator which can extend the entire length of the storage compartment. Refuse bodies having full ejection, especially front-loader and side-loader type bodies having long storage areas, typically utilize one or more multi-stage hydraulic cylinders (i.e., units well known in the art comprising a barrel, one or more telescoping, fluid actuated sleeves and a telescoping, fluid actuated plunger which allows the extended unit to "telescope" to several times its retracted length) to achieve the required length of movement required. Although these multi-stage cylinders may provide a compact actuator unit with long extension length, they are generally significantly more expensive to purchase initially, significantly more expensive and complicated to maintain, and generally have a significantly shorter life than single-stage cylinders (i.e., units having only a single movable fluid actuated rod) used under the same conditions.

In some refuse bodies using full ejection to eject the packed bale, especially front-loader and side-loader type bodies having long storage areas, the same multi-stage hydraulic cylinders used for the ejecting operation are also used for the refuse packing operation. In such cases, the multi-stage cylinders are partially extended (i.e., extended only a portion of their full length) to perform the packing operation and are fully extended only to perform the ejecting operation. Such a design thus requires only one type of actuator to accomplish two functions. However, these designs subject the multi-stage cylinders to relatively high-frequency use since the packing operation is typically performed hundreds of times per day while the ejecting operation is typically performed only several times per day. Although the multi-stage cylinder is only partially extended most of the time, this nonetheless results in increased wear on the multi-stage cylinders and increases the need for expensive and time-consuming maintenance on them.

In rear-loader type bodies, single-stage cylinders are generally used for the packing operation (which packs from the rear) and multi-stage cylinders are generally used for the full eject operation (which ejects from the front). It is known from experience with these rear-loader type bodies that using only the single-stage cylinders for the relatively frequent packing operation and using the multi-stage cylinders only for the relatively infrequent full ejection operation results in long life and reduced maintenance on the expensive multi-stage cylinders. A need therefore exists, for an apparatus for use in front-loader and side-loader type refuse bodies in which both packing and ejecting are accomplished from the front of the storage area which utilizes only single-stage hydraulic cylinders for the packing operation.

SUMMARY OF THE INVENTION

For purposes of clarity and consistency some of the terms used in the specification and the claims hereof will now be defined. Directional terms such as "up," "down," "upper," "lower," "top," "bottom," "forward," "rearward," "front," "back," "side," "floor," "horizontal" and "vertical" refer to refuse bodies and refuse vehicles as though they were disposed in an upright, level position with the front of the body facing the normal direction of vehicle travel.

It is an object of the current invention to provide a refuse body which allows refuse to be loaded into the loading compartment at any point in the packing cycle. It is a further object of the current invention to provide a refuse body which does not require tipping the body to eject the refuse from the storage compartment. It is yet another object of the current invention to provide a refuse body in which all packing operations are accomplished through the use of single-stage hydraulic cylinders.

These and other objects of the invention are realized by providing a refuse body apparatus adapted to be mounted upon a vehicle chassis for loading, packing, and ejecting refuse. The refuse body apparatus comprises a body shell including a storage compartment and a loading compartment, a carrier member mounted for movement longitudinally in the body shell, a packing actuator connected between the body shell and the carrier member comprising only single-stage hydraulic cylinders, a packing-and-ejecting blade mounted for movement longitudinally in the body shell, an ejecting actuator connected between the packing-and-ejecting blade and the carrier member, a scraper member pivotally connected to a front wall of the loading compartment and having a free end in sliding contact with the packing-and-ejecting blade when the blade is below adjacent, and a scraper lifting actuator disposed below the scraper member to position the free end at a predetermined position when the packing-and-ejecting blade is not below adjacent.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements throughout the views, and in which.

DETAILED DESCRIPTION OF THE INVENTION

Figure 1:
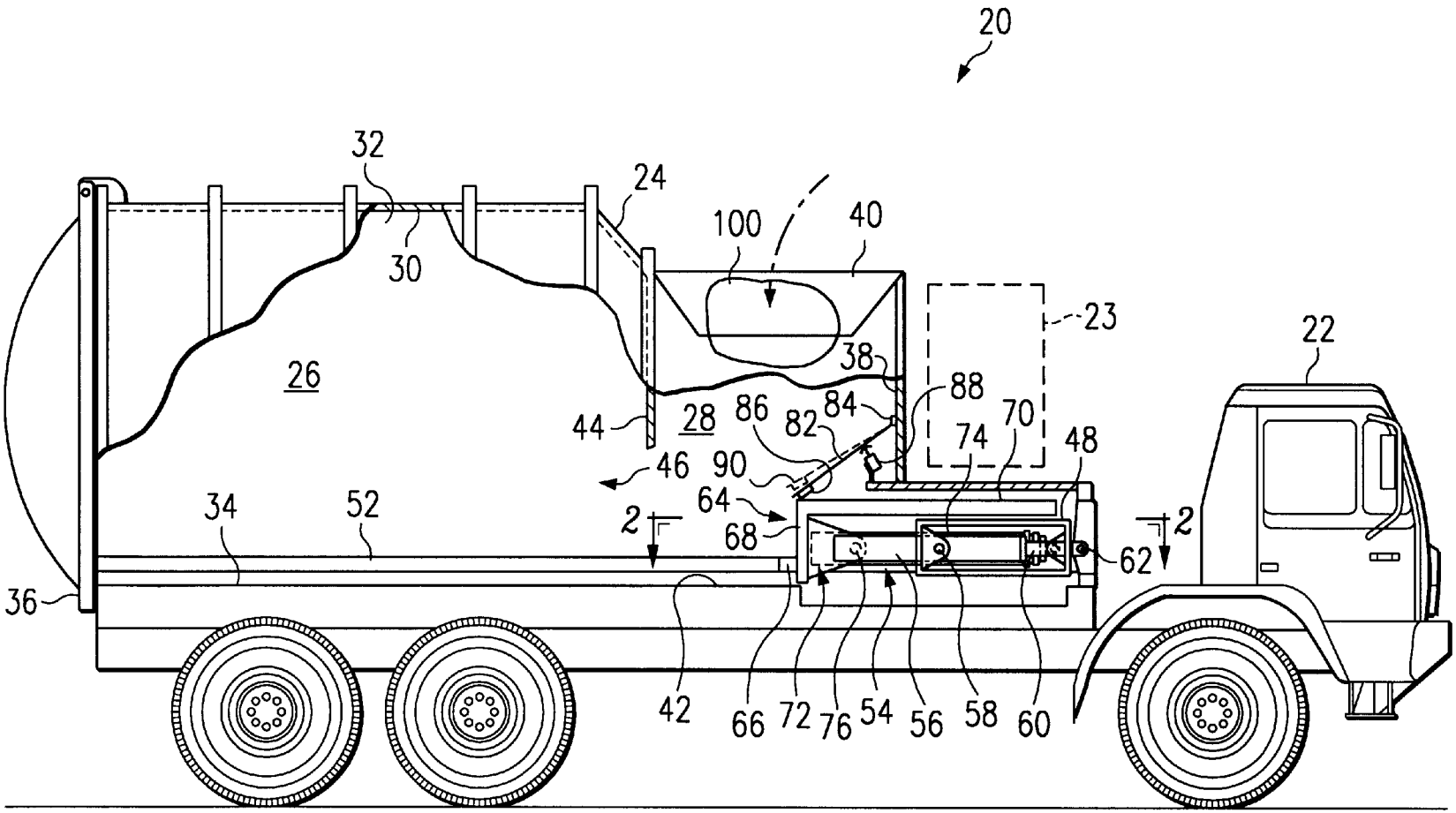
FIG. 1 is a side elevation view with parts broken away of a refuse body according to one embodiment of the current invention shown mounted upon the chassis of a vehicle of conventional design of a type generally known as a side loader illustrating the various elements of the refuse packing and ejecting apparatus in loading position.
Figure 2:
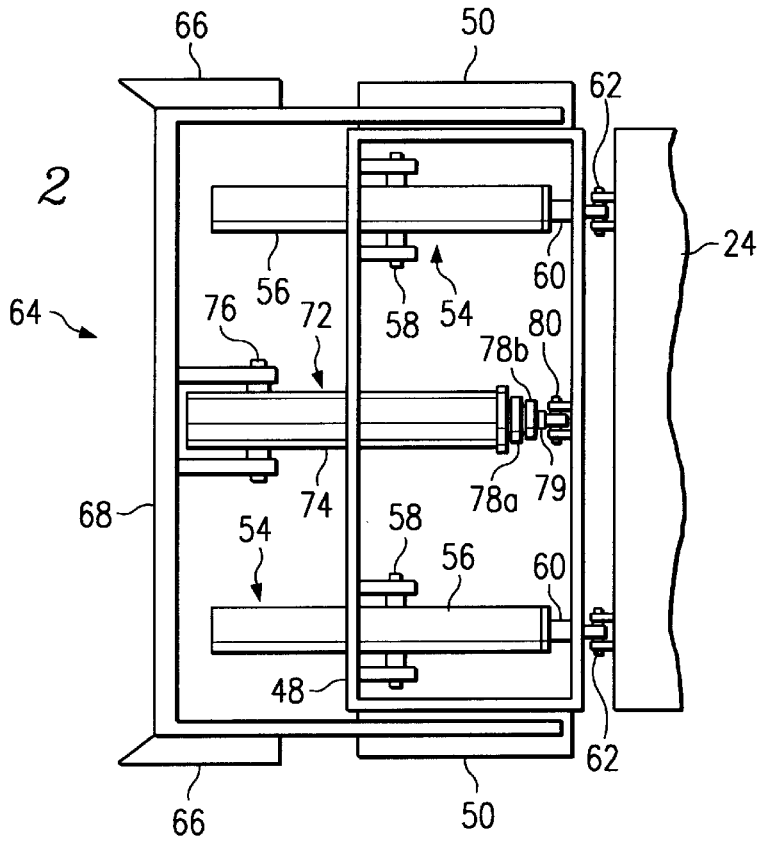
FIG. 2 is a fragmentary plan view taken along lines 2—2 of FIG. 1 showing the various elements of the refuse packing and ejecting apparatus in loading position.

Referring generally to FIGS. 1–6, a preferred embodiment of a refuse body in accordance with the current invention is shown. Referring specifically to FIGS. 1 and 2 refuse body apparatus 20 is adapted to be mounted upon a vehicle chassis 22 for loading, packing and injecting refuse. In the preferred embodiment, vehicle chassis 22 is a conventional refuse truck chassis which can be configured as either a side-loader type vehicle or a front-loader type vehicle according to the selection of container retrieval mechanism 23 (shown generally in phantom) or chassis 22 could be a trailer chassis designed to be towed by a tractor type truck.

Refuse body 20 includes a body shell 24 having a storage compartment 26 and a loading compartment 28.

Storage compartment 26 is defined by a top 30, side walls 32, a floor 34, an openable door 36 normally closing the rear of the storage compartment, and loading compartment 28 disposed at the front of storage compartment 26. Loading compartment 28 is defined by a front wall 38, side walls 40 lying generally in the plane as side walls 32 of the storage compartment, a floor 42 lying generally in the same plane as floor 34 of the storage compartment, and a rear wall 44 that is common with storage compartment 26 and extends downwardly to a level above said floors 34, 42 for defining an opening 46 from loading compartment 28 into storage compartment 26.

Referring still to FIGS. 1 and 2, refuse body apparatus 20 also includes a carrier member 48 mounted for movement longitudinally in body shell 24. In the preferred embodiment, carrier member 48 includes guides 50 which extend from the sides of carrier member 48 and engage a corresponding longitudinal channel 52 formed along the side walls 32 and 40 of body shell 24. A packing actuator 54 is connected between body shell 24 and carrier member 48. Packing actuator 54 comprises at least one double-acting (i.e., powered during both extension and retraction) single-stage hydraulic cylinder. In the preferred embodiment, packing actuator 54 comprises two double-acting single-stage hydraulic cylinders, each having a barrel portion 56 connected to carrier member 48 by trunnion 58 and rod portions 60 connected to lugs on body shell 24 by pins 62. The extension and retraction of packing actuator 54 causes longitudinal relative movement between carrier member 48 and body shell 24 since carrier member 48 is constrained to move longitudinally by the interaction of guides 50 and channel 52.

Refuse body apparatus 20 further comprises a packing-and-ejecting blade 64 mounted for longitudinal movement in body shell 24. In the preferred embodiment, packing-and-ejecting blade 64 is constrained to move longitudinally by guides 66 which extend from the side of blade 64 and engage longitudinal channel 52 formed along side walls 32 and 40 of body shell 24. Blade 64 includes a generally vertical packing face 68 and a generally horizontal top face 70. An ejecting actuator 72 is connected between packing-and-ejecting blade 64 and carrier member 48. In the preferred embodiment of the current invention, ejecting actuator 72 comprises a double-acting multi-stage hydraulic cylinder comprising a barrel portion 74 connected to packing-and-ejecting blade 64 by trunnion 76, extendable sleeves 78*a* and 78*b*, and extendable plunger portion 79 which is connected to lugs on carrier member 48 by pin 80. The extension and retraction of ejecting actuator 72 causes relative longitudinal movement between packing-and-ejecting blade 64 and carrier member 48 since both blade 64 and carrier member 48 are constrained to move in longitudinal channel 52 by guides 66 and 50, respectively.

Refuse body apparatus 20 also includes a scraper member 82 pivotally connected to front wall 38 of loading compartment 28. In the preferred embodiment shown, scraper member 82 is connected to front wall 38 by hinge 84. Scraper member 82 has a free end 86 in sliding contact with top face 70 of packing-and-ejecting blade 64 when blade 64 is below adjacent to free end 86. In the preferred embodiment shown, free end 86 of scraper member 82 is comprised of a high density plastic material designed to resist abrasion caused by the movement of top surface 70. A scraper lifting actuator 88 is disposed below scraper member 82 to position free end 86 of scraper member 82 at a predetermined position 90 when packing and ejector blade 64 is not below adjacent to free end 86.

Normal operation of a refuse body according to the current invention can now be described. FIGS. 1 and 2 depict a refuse body 20 according to the current invention with packing-and-ejecting blade 64 in the loading position, i.e., with both packing actuator 54 and ejecting actuator 72 retracted. Refuse material 100 (shown in phantom) is dumped into loading compartment 28 where it either falls directly to floor 42 or falls on scraper member 82 and is deflected to the floor.

Figure 4:
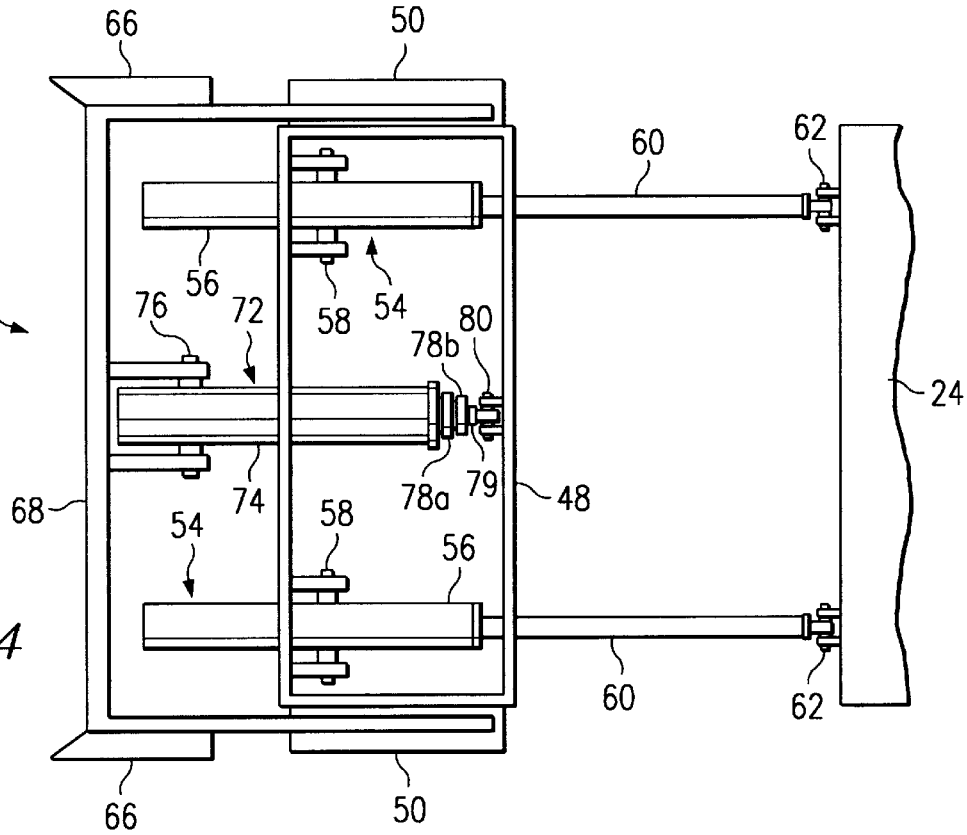
FIG. 4 is a fragmentary plan view similar to FIG. 2 but taken along lines 4—4 of FIG. 3 illustrating the packing and ejecting apparatus in packing position.
Figure 3:
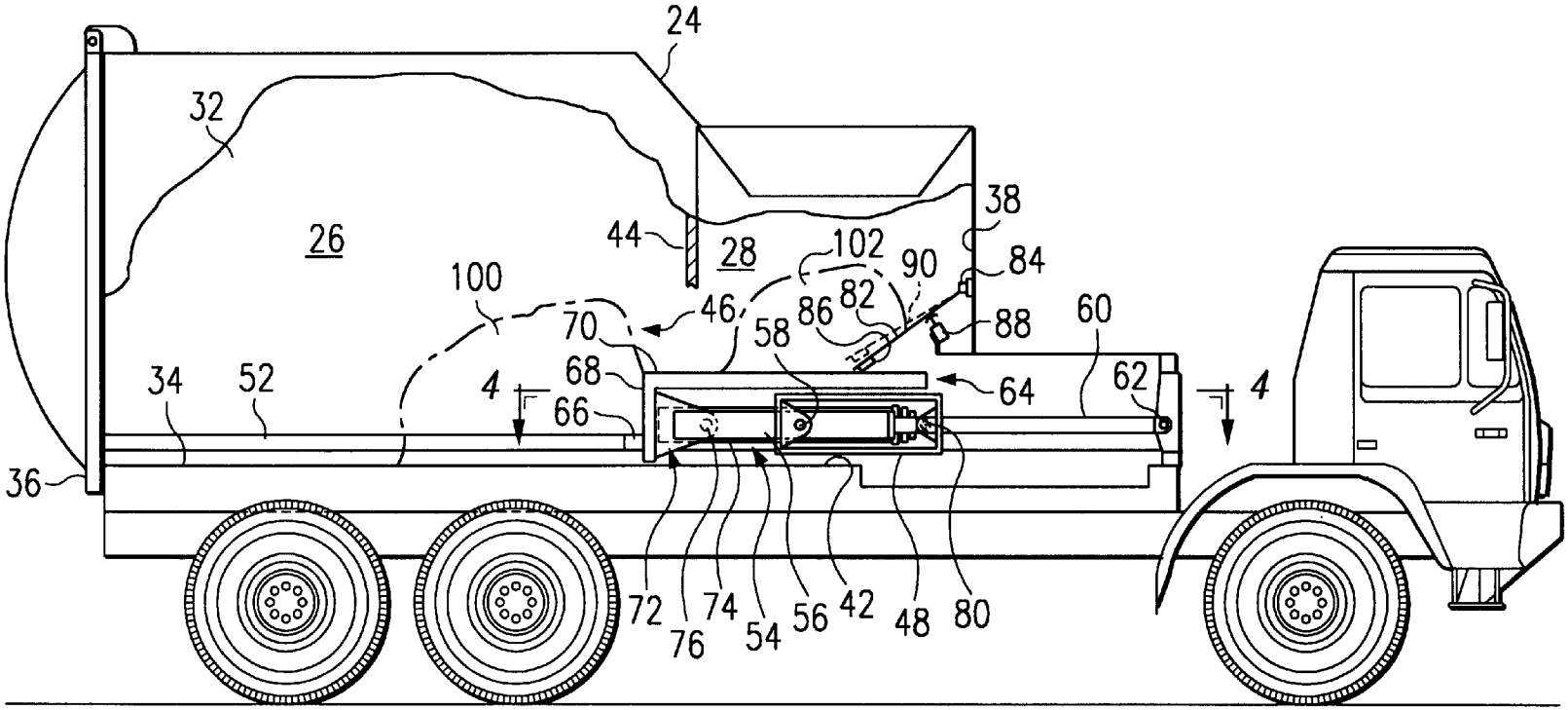
FIG. 3 is a simplified side elevation view similar to FIG. 1 but illustrating the packing and ejecting apparatus in packing position.

Referring now to FIGS. 3 and 4, extension of packing actuator 54 causes carrier member 48, ejecting actuator 72, and packing-and-ejecting blade 64 to move longitudinally rearward as a unit into the packing position shown in FIGS. 3 and 4. This movement causes packing face 68 of blade 64 to push any refuse 100 (shown in phantom) on floor 42 of loading compartment 28 through opening 46 and into storage compartment 26. As refuse 100 accumulates in storage compartment 26, additional cycling of packing actuator 54 will cause the refuse to be packed into a dense bale (not shown). Additional refuse 102 (shown in phantom) may be dumped into loading compartment 28 at any time during the packing operation because scraper member 82 and blade top face 70 will prevent the material from falling beneath packing-and-ejecting blade 64 where it could jam the mechanism.

When packing actuator 54 is retracted, carrier member 48, ejecting actuator 72, and packing-and-ejecting blade 64 move longitudinally forward as a unit, returning to the loading position of FIGS. 1 and 2 and completing the packing cycle. During retraction, scraper member 82 will remove refuse 102 from top face 70 of the blade and dump it onto floor 42 so that it can be packed in the next packing cycle. Note that in this preferred embodiment, the packing operation is accomplished solely through the actuation of the single acting hydraulic cylinders of packing actuator 54. Actuation of ejecting actuator 72 is not required for the packing operation. This prevents unnecessary wear on the expensive, multi-stage hydraulic cylinder of ejecting actuator 72.

Figure 5:
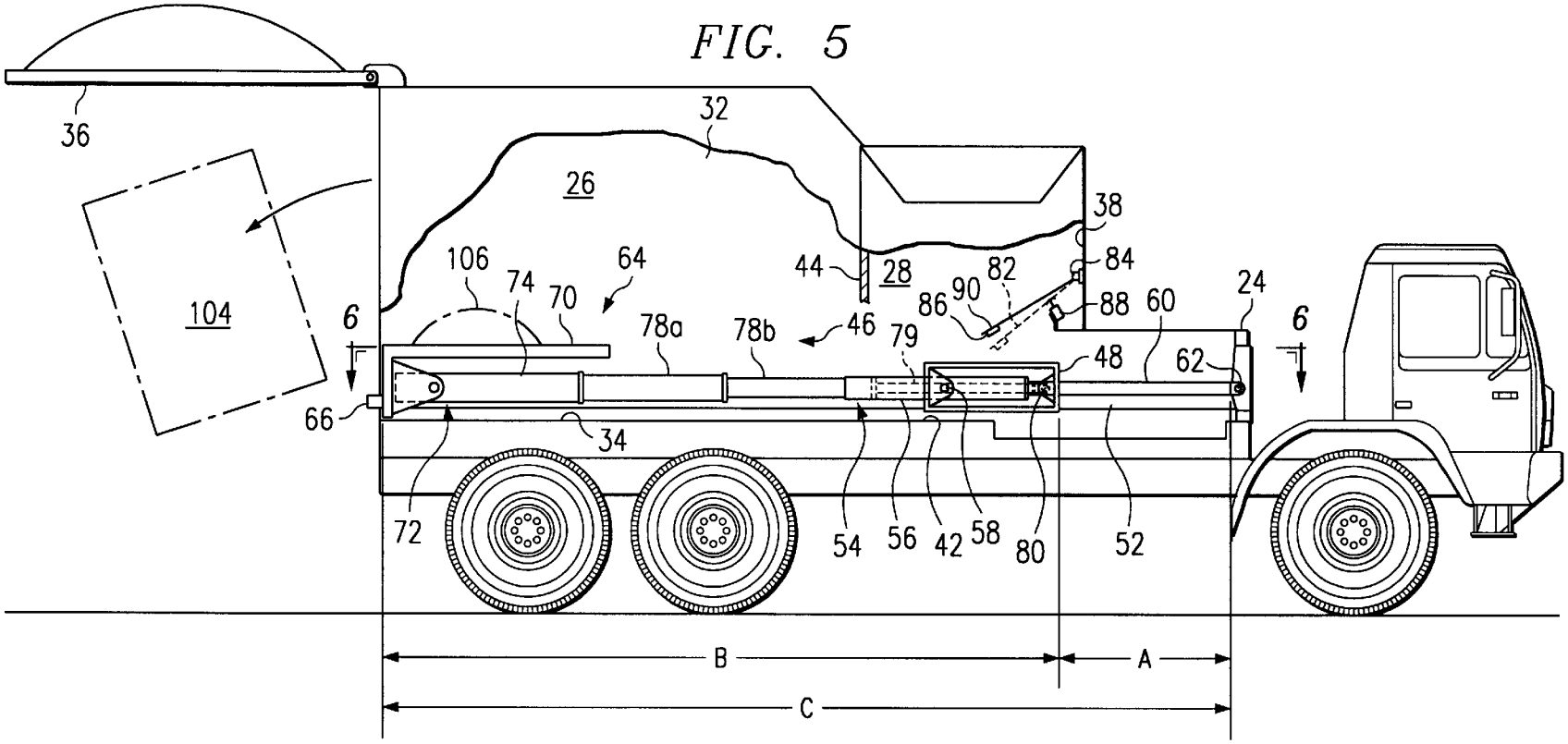
FIG. 5 is a simplified side elevation view similar to FIGS. 1 and 3 but illustrating the packing and ejecting apparatus in ejecting position and the rear door open to allow ejection of a refuse bale.
Figure 6:
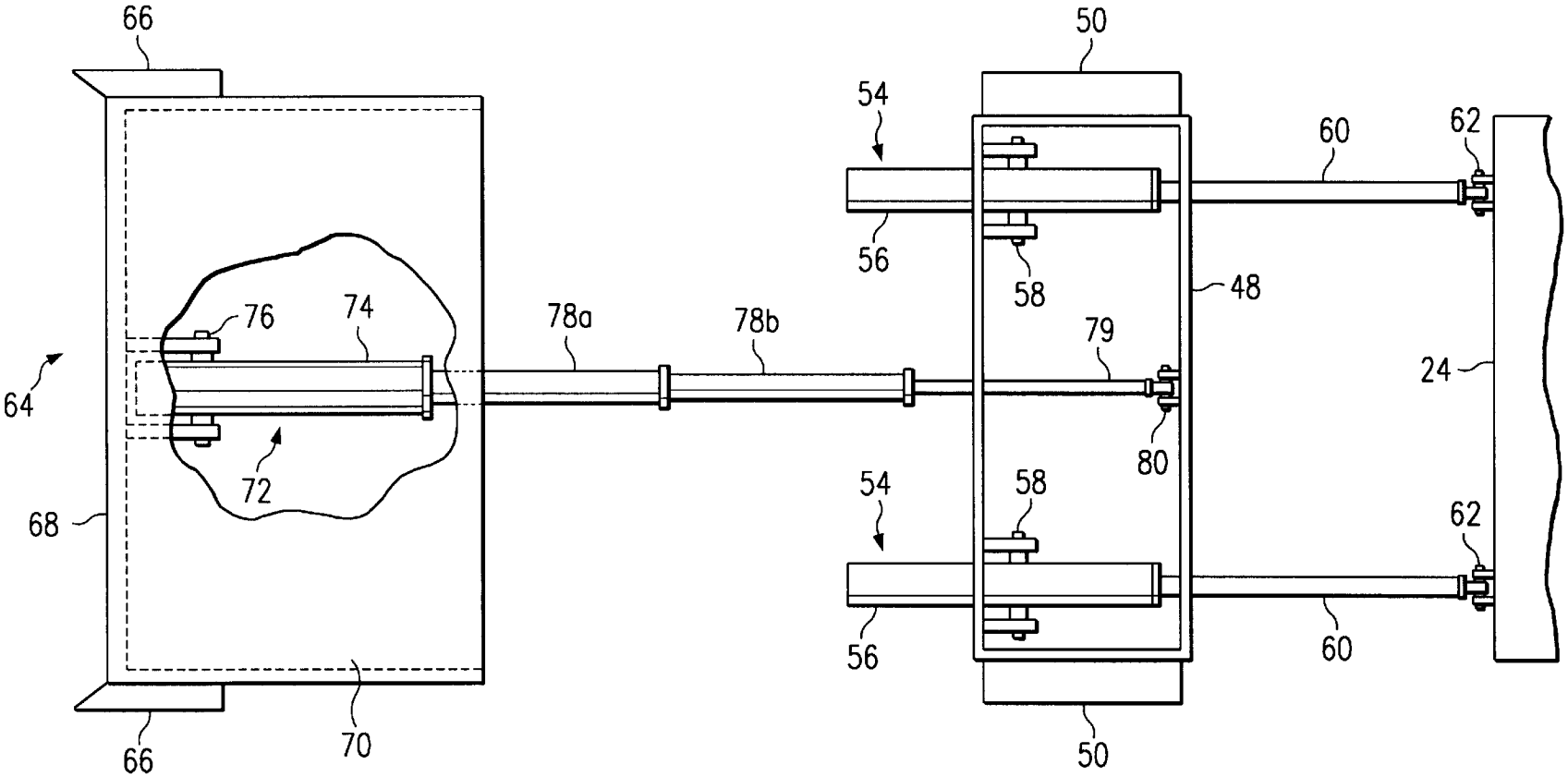
FIG. 6 is a fragmentary plan view with parts broken away similar to FIGS. 2 and 4 but taken along lines 6—6 of FIG. 5 illustrating the packing and ejecting apparatus in ejecting position.

Referring now to FIGS. 5 and 6, extension of packing actuator 54 causes carrier member 48 to move longitudinally rearward a distance A relative to body shell 24 and the cooperative extension of ejecting actuator 72 causes packing-and-ejecting blade 64 to move longitudinally rearward a distance B relative to carrier member 48 so that blade 64 assumes the ejecting position shown in FIGS. 5 and 6. This rearward movement of blade 64 causes a bale 104 (shown in phantom) of compacted refuse to be pushed out the rear end of storage compartment 26 through door 36 which has been previously opened. In the preferred embodiment, side walls 32 of the storage compartment 26 are not precisely parallel, rather they diverge slightly, i.e., the width of storage compartment 26 is slightly larger at the rear end than at the front end. These diverging side walls 32 prevent refuse bale 104 from binding as it is being ejected by blade 64. Any residual refuse material 106 (shown in phantom) that falls from compacted bale 104 as it is being ejected will fall onto top face 70 of packing-and-ejecting blade 64 and will be removed when blade 64 is retracted.

As previously discussed, since packing actuator 54 has moved carrier member 48 a distance A from the front end of body shell 24, ejecting actuator 72 must only extend rearward a distance B in order to accomplish ejecting of the refuse bale rather than moving the entire distance C which would have been required to eject bale 104 without the cooperative use of packing actuator 54 to assist in ejection. In this manner, the requirements for ejecting actuator 72 may be met through the use of a multi-stage hydraulic cylinder having at least one fewer stages than would be required without the cooperative use of packing actuator 54.

When packing actuator 54 and ejecting actuator 72 are retracted, packing-and-ejecting blade 64 and carrier member 48 are returned to the loading position shown in FIGS. 1 and 2. As blade 64 approaches free end 86 of scraper member 82, scraper lifting actuator 88 will lift free end 86 to predetermined position 90 so that it will not interfere with the return motion of blade 64. After top face 70 has become below adjacent to scraper free end 86, actuator 88 will allow free end 86 to resume sliding contact with top face 70 so that any residual refuse 106 can be pushed onto loading compartment floor 42. Since this ejection cycle operation is only performed a few times each day, the current invention minimizes wear on ejecting actuator 72. This is especially important in cases where the ejecting actuator is a multi-stage hydraulic cylinder.

While the preferred embodiment of the invention has been disclosed with reference to a particular refuse body and the method of operation thereof, it is to be understood that many changes in detail may be made as a matter of engineering choices without departing from the spirit and scope of the invention, as defined by the appended claims.

I claim:

1. A refuse loading, packing, and ejecting apparatus mountable within a refuse body shell having a storage compartment with an internal vertical height defined by the vertical distance between a top and a floor of said storage compartment, said apparatus comprising: a packing actuator, a carrier member, an ejecting actuator, a packing-and-ejecting blade, a scraper member and a scraper lifting actuator;

said carrier member and said packing-and-ejecting blade each being mountable within said body shell to allow longitudinal movement within said body shell;

said packing-and-electing blade including a generally vertical packing face and a generally horizontal top face connected to said packing face, the vertical distance between the top of said packing face and said floor defining a vertical height, said vertical height of the packing face being substantially less than the internal vertical height of the storage compartment, the horizontal distance between the forward edge of said top face and the rearward edge of said top face defining a horizontal length of said top face, said horizontal length of said top face being greater than said vertical height of said packing face;

one of said packing actuator and said ejecting actuator having a first end connectable to said body shell and a second end connected to said carrier member;

another of said packing actuator and said ejecting actuator having a first end connected to said carrier member and a second end connected to said packing-and-ejecting blade;

said packing actuator comprising a double-acting single-stage hydraulic cylinder and being selectively extendable and retractable to produce longitudinal movement of said packing-and-ejecting blade through a first distance relative to said body shell;

said first distance being sufficient for said packing-and-ejecting blade to pack refuse within said body shell and insufficient for said packing-and-ejecting blade to completely eject refuse from said body shell;

said ejecting actuator comprising a double-acting hydraulic cylinder and being selectively extendable and retractable to produce longitudinal movement of said packing-and-ejecting blade through a second distance relative to said body shell;

said second distance being insufficient for said packing-and-ejecting blade to completely eject refuse from said body shell;

the sum of said first distance and said second distance being sufficient for said packing-and-ejecting blade to completely eject refuse from said body shell;

said scraper member having a first end pivotally connectable to said body shell;

said scraper member having a free end in sliding contact with said top face of said packing-and-ejecting blade when said packing-and-ejecting blade is vertically beneath said free end of said scraper member; and said scraper lifting actuator being positioned adjacent said scraper member and positioning said free end of said scraper member at a predetermined position when said packing-and-ejecting blade is not vertically beneath said free end of said scraper member.

2. An apparatus according to claim 1, wherein said packing actuator comprises two double acting single-stage hydraulic cylinders having a first end connectable to said body shell and a second end connected to said carrier member.

3. An apparatus according to claim 2, wherein said ejecting actuator comprises a double acting three-stage hydraulic cylinder having a first end connected to said carrier member and a second end connected to said packing-and-ejecting blade.

4. A refuse body apparatus mountable on a vehicle chassis for loading, packing, and ejecting refuse, said apparatus comprising:

(a) a body shell including a storage compartment and an adjacent loading compartment;

said storage compartment being defined by a top, side walls, a floor, a door being positioned at the rear of said storage compartment, and a partial wall being positioned at the front of said storage compartment, the vertical distance between said top and said floor defining an internal vertical height of said storage compartment;

said loading compartment being defined by a front wall, side walls lying generally in the same planes as the side walls of said storage compartment, a floor lying generally in the same plane as the floor of said storage compartment, and said partial wall being positioned at the rear of said loading compartment extending downwardly to a level above said floors defining a passage from said loading compartment into said storage compartment;

(b) a carrier member mounted for longitudinal movement within said body shell;

(c) a packing actuator connected between the front of said body shell and said carrier member;

said packing actuator comprising a double acting single-stage hydraulic cylinder;

extension and retraction of said packing actuator producing relative movement between said carrier member and said body shell;

(d) a packing-and-ejecting blade mounted for longitudinal movement within said body shell;

said packing-and-ejecting blade including a generally vertical packing face and a generally horizontal top face, the vertical distance between the top of said packing face and said floor of said loading compartment defining a vertical height of said packing face, said vertical height of said packing face being substantially less than the internal vertical height of the storage compartment;

(e) an ejecting actuator connected between said packing-and-ejecting blade and said carrier member;

said ejecting actuator comprising a double-acting hydraulic cylinder;

extension and retraction of said ejecting actuator producing relative movement between said packing-and-ejecting blade and said carrier member;

(f) a scraper member having a first end pivotally connected to said front wall of said loading compartment;

said scraper member having a free end in sliding contact with said top face of said packing-and-ejecting blade when said packing-and-ejecting blade is vertically beneath said free end of said scraper member; and (g) a scraper lifting actuator positioned adjacent said scraper member to position said free end at a predetermined position when said packing-and-ejecting blade is not vertically beneath said free end of said scraper member.

5. A refuse body apparatus according to claim 4, further comprising a power-actuated lifting mechanism for elevating refuse containers and dumping their contents into said loading compartment.

6. A refuse body apparatus according to claim 5, wherein said lifting mechanism is adapted to cooperate with refuse containers accessible from the front of the vehicle.

7. A refuse body apparatus according to claim 6, wherein said lifting mechanism is adapted to cooperate with refuse containers accessible from the side of the vehicle.

8. A method of loading, packing, and ejecting refuse in a refuse body shell, said method comprising the steps:

(a) loading a quantity of refuse into a loading compartment of said refuse body shell;

(b) extending a packing actuator comprising a double acting single-stage hydraulic cylinder to move a packing-and-ejecting blade longitudinally within said refuse body shell from an initial position to a second position to pack said refuse from said loading compartment into a storage compartment of said refuse body shell;

(c) loading an additional quantity of refuse into said loading compartment of said refuse body shell when said packing actuator is extended and said packing-and-ejecting blade is in said second position;

(d) retracting said packing actuator to return said packing-and-ejecting blade from said second position to said initial position;

(e) repeating steps (a)–(d) until ejection of said refuse in said storage compartment is desired;

(f) extending said packing actuator and extending an ejecting actuator comprising a double acting hydraulic cylinder, either simultaneously or in any sequence, to move said packing-and-ejecting blade longitudinally within said refuse body shell from said initial position to a third position to eject said refuse from said storage compartment;

said second position being located between said initial position and said third position (g) retracting said packing actuator and retracting said ejecting actuator to return said packing-and-ejecting blade from said third position to said initial position, this step including the substeps of;

(i) using a scraper lifting actuator mounted on said refuse body shell to position a free end of a scraper member at a predetermined position when said packing-and-ejecting blade is located between said second position and said third position, said predetermined level providing vertical clearance between said free end of said scraper member and the upper surface of said packing-and-ejecting blade; and (ii) using said scraper lifting actuator to allow said free end of said scraper member to contact said upper surface of said packing-and-ejecting blade when said packing-and-ejecting blade is located between said second position and said initial position.

9. A refuse loading, packing, and ejecting apparatus mountable within a refuse body shell having a storage compartment, said apparatus comprising:

a packing-and-ejecting blade mounted within said body shell to allow longitudinal movement within said body shell, said packing-and-ejecting blade including a generally vertical packing face and a generally horizontal top face connected to said packing face;

a scraper member having a first end pivotally mounted within said body shell;

said scraper member having a free end in sliding contact with said top face of said packing-and-ejecting blade when said packing-and-ejecting blade is vertically beneath said free end of said scraper member; and a scraper lifting actuator being operably connected to said scraper member and positioning said free end of said scraper member at a predetermined vertical position when said packing-and-ejecting blade is not vertically beneath said free end of said scraper member.

* * * * *

UNITED STATES PATENT AND TRADEMARK OFFICE

CERTIFICATE OF CORRECTION

PATENT NO : 6,146,078

DATED : November 14, 2000

INVENTOR(S) : Odis F. HAMILL and Hooshang A. BEFRUI

It is certified that error appears in the above-identified patent and that said Letters Patent is hereby corrected as shown below:

Column 6, line 53 (claim 1, line 12), delete "electing", and insert --ejecting--.

Column 7, line 5 (claim 1, line 31), delete "double-acting", and insert --double acting--.

Column 9, line 15 (claim 8, line 33), delete ";", and insert":".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*